US005535605A

United States Patent [19]

Werner

[11] Patent Number: 5,535,605

[45] Date of Patent: Jul. 16, 1996

[54] GUN LOCK

[75] Inventor: Theodore J. Werner, Dix Hills, N.Y.

[73] Assignee: United States Marketing Corporation, Huntington Station, N.Y.

[21] Appl. No.: 518,235

[22] Filed: Aug. 23, 1995

Related U.S. Application Data

[63] Continuation-in-part of Ser. No. 236,028, May 2, 1994, abandoned.

[51] Int. Cl.[6] ..... E05B 37/02; F41A 17/02

[52] U.S. Cl. ..... 70/14; 42/70.06; 42/70.07; 70/202; 70/230; 70/312

[58] Field of Search ..... 70/201–203, DIG. 57, 70/312, 229, 230, 232, 25, 14, DIG. 58, 57, 58; 42/70.06, 70.07, 70.11

[56] References Cited

U.S. PATENT DOCUMENTS

| | | | |
|---|---|---|---|
| 1,503,043 | 7/1924 | Greer | 70/25 |
| 1,843,348 | 2/1932 | Stern | 70/230 |
| 2,478,339 | 8/1949 | Sullivan | 70/230 |
| 3,066,433 | 12/1962 | Rogers et al. | 42/70.06 |
| 3,139,694 | 7/1964 | Schaefer | 42/70.06 |
| 3,392,471 | 7/1968 | Foote | 42/70.06 |
| 3,422,560 | 1/1969 | Foote et al. | 42/70.06 |
| 3,624,945 | 12/1971 | Foote | 42/70.07 X |
| 4,499,681 | 2/1985 | Bako et al. | 42/70.07 |
| 5,169,326 | 12/1992 | Werner | 70/23 X |
| 5,309,661 | 5/1994 | Fuller et al. | 42/70.07 |

*Primary Examiner*—Lloyd A. Gall
*Attorney, Agent, or Firm*—Charles E. Baxley

[57] ABSTRACT

A two-piece combination lock for use in locking a gun trigger includes a backup member having two cantilevered screws and includes a casing having a chamber containing a lock subassembly with a generally U-shaped frame member for locking the two screws and adjusting the space between the backup member and the casing and having a combination lock unit with three numbered dials for preventing unlocking when the combination is incorrect.

4 Claims, 3 Drawing Sheets

GUN LOCK

BACKGROUND OF INVENTION

This aApplication is a Continuation-in-Part of my U.S. patent application Ser. No. 08/236028 filed on May 2, 1994, now abandoned.

This invention relates to a gun combination lock and more particularly relates to a gun combination lock for the trigger of a gun and more specifically relates to a gun combination lock for the trigger of a gun having a front member with two holes and respective spring-biased threaded locking arms and a back member with two threaded members for insertion into the respective two holes in the front member.

DESCRIPTION OF THE PRIOR ART

The prior art combination lock is described in U.S. Pat. No. 5,169,326 issued Dec. 8, 1992 for an electric plug guard having a casing with a chamber containing a lock subassembly which includes a generally U-shaped frame, a lock member with two side-by-side projections for locking two prongs of the electric plug and a shaft member on which three combination dials are journaled, One problem with the prior art combination lock is that relatively large transverse forces on the electric plug prongs can cause tilting and bending of the generally U-shaped frame in the plane of the frame.

Another problem with the prior art combination lock is that the length of the plug prongs is fixed and cannot pass through the casing.

OBJECTS AND SUMMARY OF INVENTION

A principal object of the present invention is to provide a combination lock for a gun trigger.

Another object of the present invention is to provide a combination lock having an adjustable width between the pieces thereof.

A further object of the present invention is to provide a casing having a combination lock subassembly contained therein which minimizes twisting and tilting thereof due to transverse forces applied by the lock screws.

According to the present invention, a gun lock is provided having a front casing with two holes extending therethrough and with a lock subassembly disposed therein and having a backup member with two elongated threaded members cantilevered therefrom and extending through the holes for adjusting the space between the front casing and the backup member, said lock subassembly having a generally U-shaped frame having a central shaft leg for combination dials and having a left member with a threaded projection for locking one threaded member and having a right member with a threaded projector for locking the other threaded member.

By using one member to lock one screw disposed on one side of the dial shaft and using another member to lock the other screw disposed on the other side of the dial shaft, tilting and bending of the other side of the U-shaped frame due to a balance of the imposed transverse forces is minimized.

By using pass-through holes in the casing, the length of the threaded members are not fixed or limited, allowing for adjustment of the space between the casing and the backup member.

DESCRIPTION OF THE DRAWINGS

The foregoing and other objects and advantages of the present invention will be readily appreciated as the same becomes better understood by reference to the following detailed description when considered in connection with the accompanying drawings, in which.

DETAILED DESCRIPTION OF THE INVENTION

Figure 1:
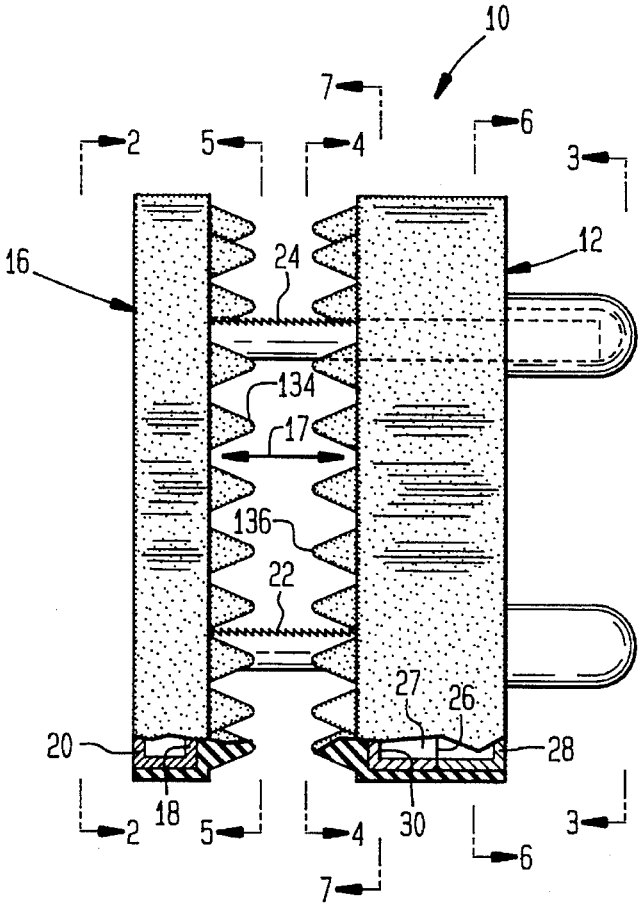
FIG. 1 is an elevational view of a gun lock according to the present invention, with portions shown broken away to reveal internal construction.
Figure 2:
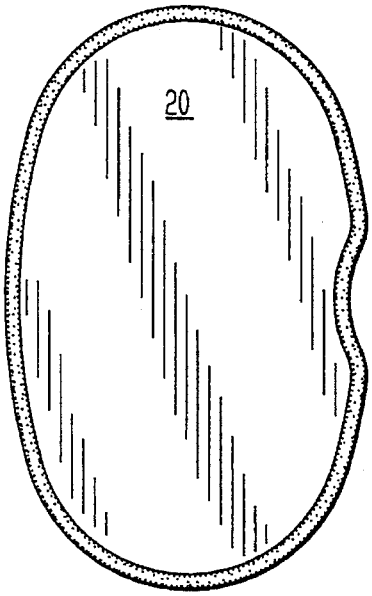
FIG. 2 is a side elevational view, taken along line 2—2 of FIG. 1.
Figure 3:
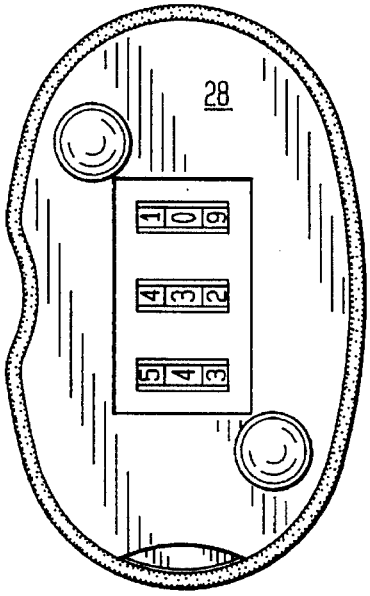
FIG. 3 is a side elevational view, taken along line 3—3 of FIG. 1.
Figure 4:
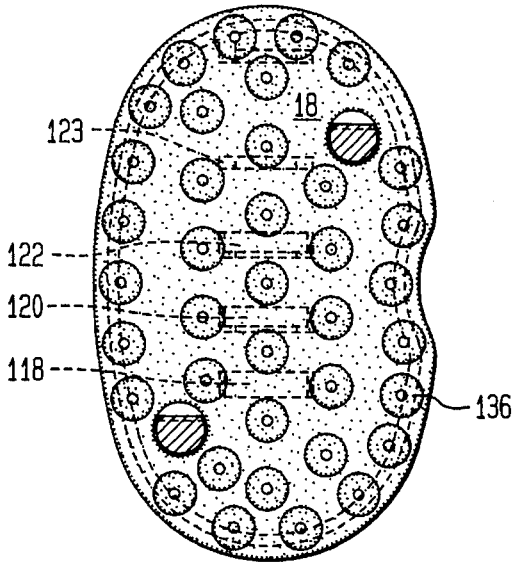
FIG. 4 is a sectional view, taken along line 4—4 of FIG. 1.
Figure 5:
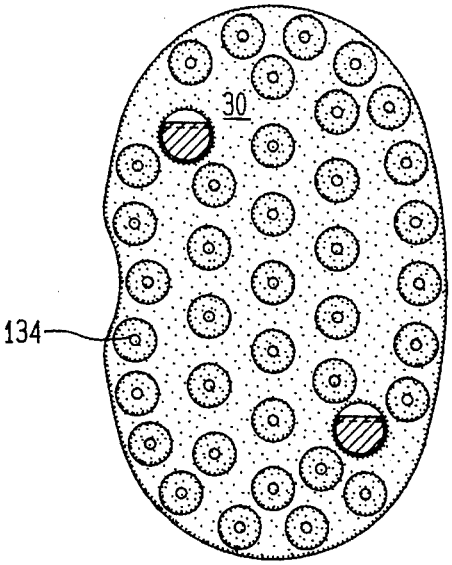
FIG. 5 is a sectional view, taken along line 5—5 of FIG. 1.
Figure 6:
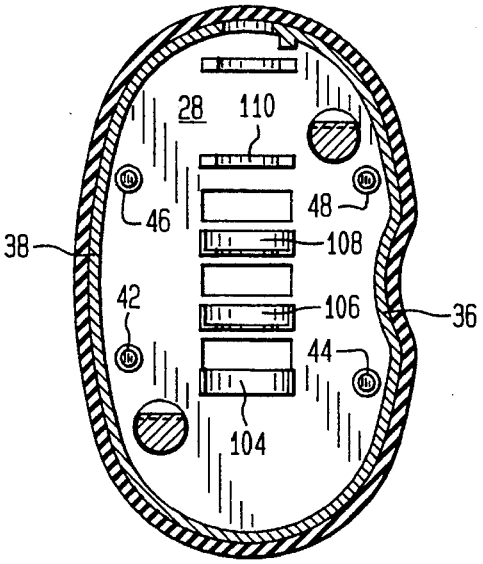
FIG. 6 is a sectional view, taken along line 6—6 of FIG. 1.

With reference to the drawings, wherein like reference numbers designate like or corresponding parts throughout, there is illustrated in FIGS. 1 through 11 a gun lock 10 which comprises a gun combination member or casing 12 which contains a lock subassembly 14 therein. The gun lock 10 has a backup member 16, which forms an adjustable space 17 with the front member 12. The gun lock 10 is used by placing the backup member 16 on one side of a gun trigger and engaging the front member 12 on the opposite side of the gun trigger and pressing both the backup member 16 to the front member 12, as will hereinafter be described.

The backup member 16 has a front wall 18 and a rear wall 20. The wall 18 has two cantilevered screws 22, 24 which are respectively received by the front member 12.

As shown in FIGS. 1 through 7, the front member 12 includes a chamber 27 which has an assembly joint 26. The chamber 27 has a front wall 28, a rear wall 30, a bottom wall 32, a top wall 34, a left sidewall 36, a right sidewall 38 and a partition or support wall 40. The wall 28 shown in FIG. 6 has four dowel holes 50, 52, 54, 56 shown in FIG. 7 in which respective posts 42, 44, 46, 48 (FIG. 6) are press fit, upon assembly thereof.

The lock subassembly 14 has a generally U-shaped frame member 58 (FIG. 7), a coil spring 60, which urges the frame 58 to a lock position, and a combination number latch 62 which latches the frame 58 until unlocked by using a selective combination of a three-digit number.

Figure 11:
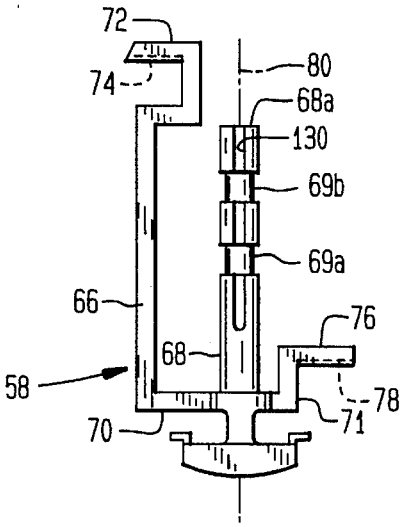
FIG. 11 is a view of a part of the subassembly of FIG. 8.

As shown in FIG. 11, the generally U-shaped frame 58 has a left lock member 66, a center shaft member 68, a base member 70, and a threaded surface portion 74. Right member 71 has an arm 76 with a threaded surface portion 78. Thus, threaded surfaces 74, 78 are urged by spring 60 into threads of the respective screws 24, 22 for locking the screws 24, 22 in place. The shaft 68 has an axis 80 along which the force of the spring 60 is applied (in a downward direction in FIG. 8), through the frame 58 to the screws 24, 22. Further, reaction forces from the screws 22, 24 act on opposite sides of the axis 80 so that any tilting moment on the frame 58 is minimized.

The frame 58 has an actuator or button portion 82 (FIG. 7) which extends through an opening 84 in the bottom wall 32. In operation, when the button 82 is pressed in an upward direction (FIG. 7), the button 82 causes a displacement of the frame 58 and causes the arms 72, 76 (FIG. 11) to withdraw from the screws 24, 22 if the selective unlock number (combination) is used. The subsequent release of pressure on the button 82 causes the spring 60 to urge the frame 58 in a downward direction thereby locking the screws 22, 24 to the arms 76, 72.

Figure 7:
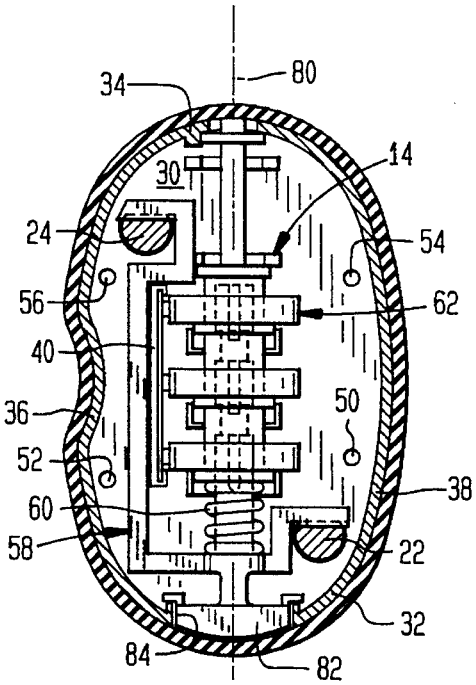
FIG. 7 is a sectional view, taken along line 7—7 of FIG. 1.
Figure 8:
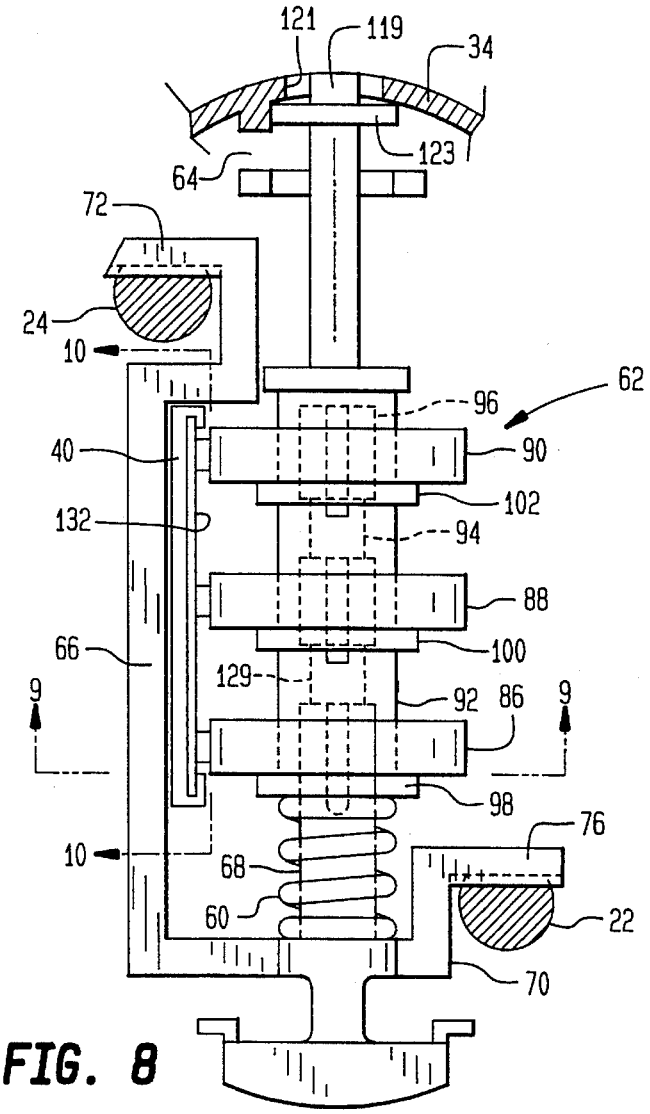
FIG. 8 is an enlarged view of a portion of FIG. 7.

As shown in FIGS. 7 and 8, the combination latch 62 has three outer, axially spaced, dials 86, 88, 90 which are axially spaced and which are journaled respectively on three middle cylinders 92, 94, 96. The cylinders 92, 94, 96, in turn, are journaled on the shaft 68. Each of the cylinders 92, 94, 96 has a respective flange 98, 100, 102 at one end thereof. The spring 60 is positioned between the flange 98 of the cylinder 92 and the base member 70. The latch 62 has four cylinder journaling parts 104, 106, 108, 110 (FIG. 6) which are fixed to the wall 28 and which position the cylinders 92, 94, 96 axially along the shaft 68. The latch 62 also has four dial-positioning pads 118, 120, 122, 123 which are fixed to the rear wall 30 and which position cylinders 92, 94, 96 at the rear wall 30 (see FIG. 4).

The latch 62 operates in analogous manner to latch 62 in U.S. Pat. No. 5,169,326, known to the art.

Figure 10:
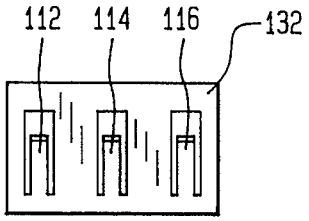
FIG. 10 is a sectional view taken along line 10—10 of FIG. 8.
Figure 9:
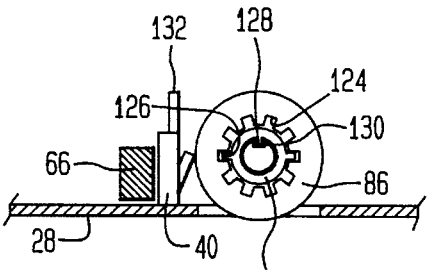
FIG. 9 is a sectional view, taken along line 9—9 of FIG. 8.

The cylinders 92, 94, 96 each have a single tooth 128 located at the inside diameter of each of the cylinders 92, 94, 96 and at the end thereof, opposite the respective flange 98, 100, 102. The casing 12 has eight cylinder journaling pads 104, 106, 108, 110 and 118, 120, 122, 123 which are fixed to the top wall 30 and the bottom wall 28 of the chamber 27 and which position the cylinders 92, 94, 96 axially along the shaft 68, so that normally the tooth 128 from the cylinders 92 and 94 are axially located in the grooves 69*a* and 69*b* respectively while the tooth 128 from the cylinder 96 extends upwardly beyond the end 68*a* of the shaft 68 (see FIGS. 8 and 11). When the set number combination is exposed, the tooth 128 from each of the cylinders 92, 94, 96 is aligned with a longitudinal groove 130 in the shaft 68 and then the frame 58 may be displaced by applying pressure to the button 82 as hereinbefore described. The latch 62 also has three dial positioning springs 112, 114, 116 which maintain the respective dials 86, 88, 90 to a rotational position to which they have been set. As shown in FIG. 10, the positioning springs 112, 114, 116 which maintain the respective dials 86, 88, 90 to a rotational position to which they have been set. As shown in FIG. 10, the positioning springs 112, 114, 116 are bent strips which are formed, supported and cantilevered from a support sheet 132 which is held between the partition wall 40 and the dials 86, 88 and 90.

As best illustrated in FIG. 8, the dial 86 which is identical to the dials 88, 90, has ten inner diameter grooves 124. The cylinder. 92, which is identical to the cylinders 94, 96, has a pair of outer teeth 126, each spaced apart 180 degrees, on the external side of the flange 98 and each of which is positioned or disposed in one of the dial grooves 124. Each of the dial grooves 124 corresponds to one of the numbers 0 through 9, which is disposed or marked on the outer surface of each of the dials 86, 88, 90. Thus the dials 86, 88, 90 and their respective cylinders 92, 94, 96 are keyed together to permit simultaneous angular displacement by turning the respective dial 86, 88 or 90 to a desired number.

Walls 18, 30 have respective, opposite-hand, pluralities of cone-shaped, rubber-line buffers 134, 136 on the outer surfaces thereof.

Members 12, 16 are composed of a plastic material. The dials 86, 88, 90 and spring 60 are composed of a metal material.

The lock subassembly 14 also is provided with a reset plate 64 (FIG. 8) which has an actuator button 119 which is received in an opening 121 that is disposed in the top wall 34. The actuator button 119 also has a ledge 123 which cooperates with a lip 117 in the casing 12 to keep the actuator button 119 depressed without any pressure being applied thereto. The reset plate 64 has a circular recess 125 which receives and supports the cylinder 96. Depression of the actuator button 119 moves the cylinders 92, 94, 96 toward the bottom wall 32 by compressing the spring 60 so that the combination numbers may be changed in analogous manner to latch 62 in U.S. Pat. No. 5,169,326, known to the art. Neither the reset plate 64 nor the button 82 may be moved, unless and until the preset combination is displayed.

In operation, resetting of the combinations of numbers is accomplished by moving the actuator button 119 inwardly relative to the casing 12 and moving it slightly laterally so that the ledge 123 is on the inside of the wall 34 and engaged the lip 117, thereby keeping the actuator button 119 depressed. The circular recess 125 moves the cylinder 96 toward the wall 32 which also moves the cylinders 94 and 92 against the bias of the coil spring 60 to compress same, so that the pair of teeth 126 from each of the respective cylinders 92, 94, 96 are disengaged from each of the respective dial grooves 124 in each of the respective dials 86, 88, 90, thereby permitting the same to be changed to a different number combination. The guide 127 guides and controls the lateral motion of the portion 129 of the reset button 119.

The pressure on the button 82 by an operator or user will axially displace the frame 58 toward the wall 34 by compressing the coil spring 60. This moves the threaded projections 74, 78 out of or clear of the screws 22, 24 in order to unlock the screws 22,24 whereby the backup member 16 may be separated from the casing 12 and thereby disengaged from the gun's trigger.

The foregoing specific embodiment of the present invention as set forth in the specification herein, is for illustrative purposes only. Various changes and modifications may be made within the spirit and scope of this invention, without departing from the main theme thereof.

I claim:

1. A two piece combination lock for use in locking a gun trigger comprising:

a backup member having a first and second threaded member cantilevered therefrom;

a hollow casing having a chamber therein and having two passthrough holes for receiving said two threaded members and being separated from the backup member by an adjustable dimension; and a locking subassembly disposed in said chamber comprising:

a generally U-shaped frame member having a first lock member for locking said first threaded member and having a second lock member for locking said second threaded member and having a central shaft member disposed between said first and second lock members;

said generally U-shaped frame being movable along an axis of said central shaft member between a locked position wherein said lock members engage said threaded members and an unlocked position wherein said lock members are withdrawn from said threaded members; and a combination number lock mounted on said central shaft member for latching and preventing said first and second lock members from moving axially to said unlocked position whenever the combination number is incorrect; whereby tilting and twisting moment of said frame about an axis normal to said shaft axis, due to reactions from said two threaded members in a locked position is minimized.

2. A lock according to claim 1, wherein said generally U-shaped frame member has a base member, said base member having an actuator extending axially outwardly through an opening in said casing.

3. A lock as claimed in claim 1, wherein said central shaft member has spring means urging said generally U-shaped frame member against said first and second threaded members.

4. A lock as claimed in claim 1, wherein said first and second lock members have respective projecting portions with threaded surfaces respectively engaging said first and second threaded members in the locked position.

* * * * *